US012220060B2

(12) United States Patent
Barnes

(10) Patent No.: US 12,220,060 B2
(45) Date of Patent: Feb. 11, 2025

(54) BED MOUNTABLE ARTICLE STORAGE ASSEMBLY

(71) Applicant: Bonita Barnes, Drexel Hill, PA (US)

(72) Inventor: Bonita Barnes, Drexel Hill, PA (US)

( * ) Notice: Subject to any disclaimer, the term of this patent is extended or adjusted under 35 U.S.C. 154(b) by 314 days.

(21) Appl. No.: 17/901,213

(22) Filed: Sep. 1, 2022

(65) Prior Publication Data

US 2024/0074593 A1 Mar. 7, 2024

(51) Int. Cl.
*A47C 21/00* (2006.01)
*B65D 25/04* (2006.01)
*B65D 25/22* (2006.01)

(52) U.S. Cl.
CPC ..... *A47C 21/00* (2013.01); *B65D 25/04* (2013.01); *B65D 25/22* (2013.01)

(58) Field of Classification Search
CPC ..... A47C 21/00; A47C 21/003; A47C 31/00; A47C 7/624; A47C 7/622; A47C 7/62; B65D 25/22; B65D 25/04; B65D 33/14; F16M 13/02; F16M 13/0005; F16M 13/022; A47K 3/281; A47G 29/00; A47G 29/093; A47G 23/0225; A47B 23/02; A47B 97/00
USPC ..... 108/49; 211/26.1; 297/188.2
See application file for complete search history.

(56) References Cited

U.S. PATENT DOCUMENTS 2,061,302 A * 11/1936 Egler ..... A47C 7/62 383/33
5,971,192 A * 10/1999 Immerman ..... A47K 5/02 220/DIG. 13
6,073,899 A 6/2000 Omrani
6,568,576 B1 5/2003 Godshaw
7,181,784 B1 2/2007 Geilear
D641,195 S 7/2011 Delong
8,205,281 B2 6/2012 Swierski
8,898,836 B1 * 12/2014 Puri ..... A61G 7/0503 248/302
9,895,001 B1 2/2018 Goldszer
2003/0221978 A1 * 12/2003 Redzisz ..... A45C 13/04 206/278
2009/0050764 A1 * 2/2009 Yankovec ..... A47C 21/00 248/231.9
2012/0201482 A1 * 8/2012 Gawronski ..... A47C 19/22 383/118
2015/0238027 A1 * 8/2015 Yeh ..... A47G 1/1653 248/307
2018/0249839 A1 * 9/2018 Cammack ..... A47C 7/624
2019/0038024 A1 2/2019 Coons
(Continued)

FOREIGN PATENT DOCUMENTS

WO WO9715282 5/1997

*Primary Examiner* — Justin C Mikowski
*Assistant Examiner* — Alison N Labarge

(57) ABSTRACT

A bed mountable article storage assembly includes a housing has an outer wall forming a top wall, a bottom wall, and a perimeter wall is attached to and extends between the top and bottom walls. The outer wall is comprised of a flexible material comprising a cloth material. A coupler is attached to the housing and engages a headboard of a bed to releasably secure the housing to the headboard. An interior of the housing comprises a resiliently compressible material that retains a shape of the housing. A plurality of pockets extends into the perimeter wall for receiving small articles. Each of the pockets comprises an elongated slot having a length equal to at least 4.0 inches.

9 Claims, 8 Drawing Sheets

(56) References Cited

U.S. PATENT DOCUMENTS

| | | | | |
|---|---|---|---|---|
| 2019/0191888 | A1 | 6/2019 | Jackson | |
| 2023/0062557 | A1 * | 3/2023 | Lattimore | A47G 29/08 |

* cited by examiner

BED MOUNTABLE ARTICLE STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to article storage device and more particularly pertains to a new article storage device for holding a plurality of small articles on a headboard of bed. This will position articles in a convenient location and will include a structure that will minimize risk of injury should the storage device come in contact with a person positioned in the bed.

(2) Description of Related Art Including Information Disclosed Under 37 CFR 1.97 and 1.98

The prior art relates to article storage devices for holding items but which are not positioned in a convenient location and which do not utilize user friendly materials.

BRIEF SUMMARY OF THE INVENTION

An embodiment of the disclosure meets the needs presented above by generally comprising a housing has an outer wall forming a top wall, a bottom wall, and a perimeter wall is attached to and extends between the top and bottom walls. The outer wall is comprised of a flexible material comprising a cloth material. A coupler is attached to the housing and engages a headboard of a bed to releasably secure the housing to the headboard. An interior of the housing comprises a resiliently compressible material that retains a shape of the housing. A plurality of pockets extends into the perimeter wall for receiving small articles. Each of the pockets comprises an elongated slot having a length equal to at least 4.0 inches.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
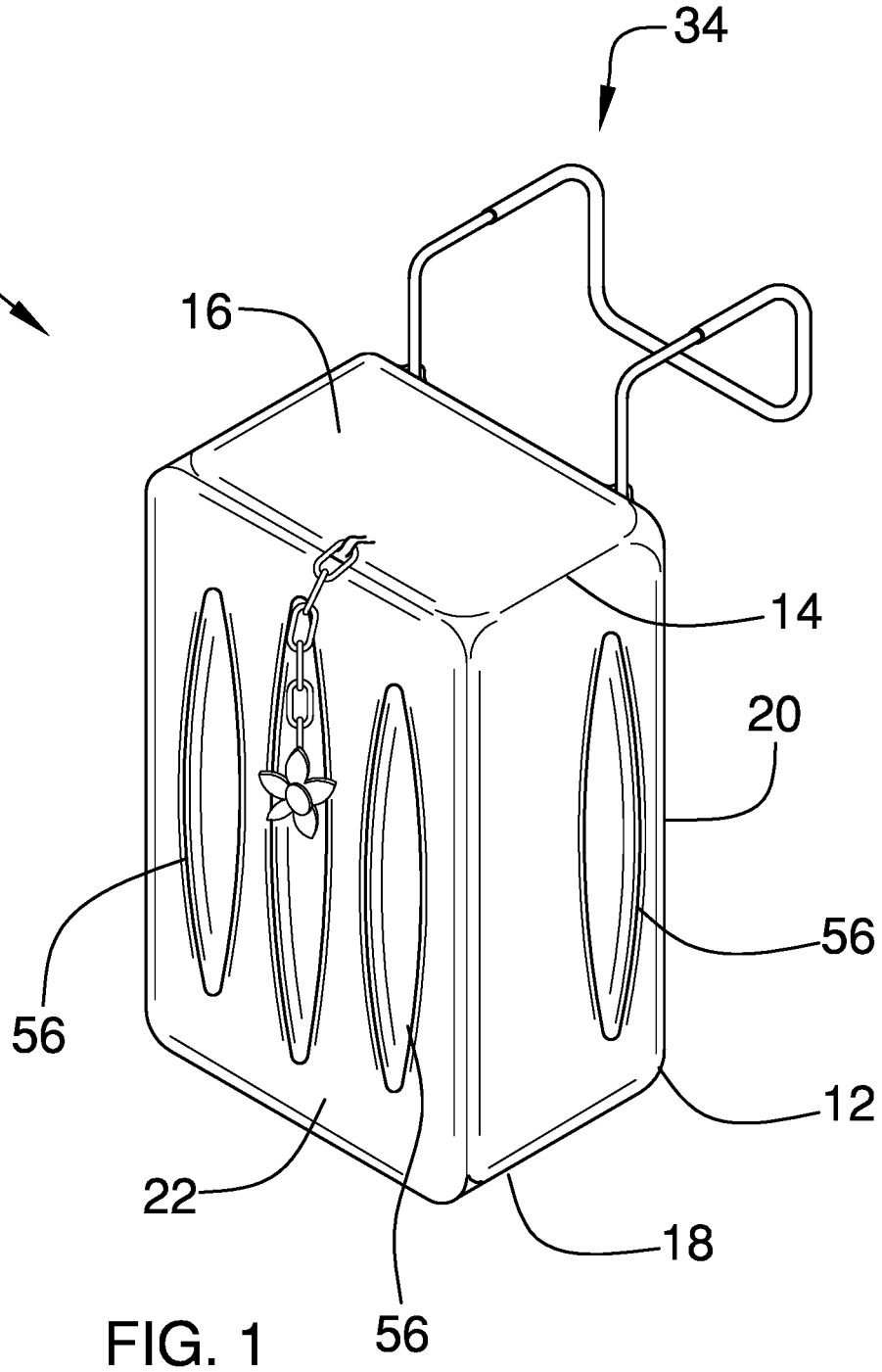
FIG. 1 is a top isometric view of a bed mountable article storage assembly according to an embodiment of the disclosure.
Figure 2:
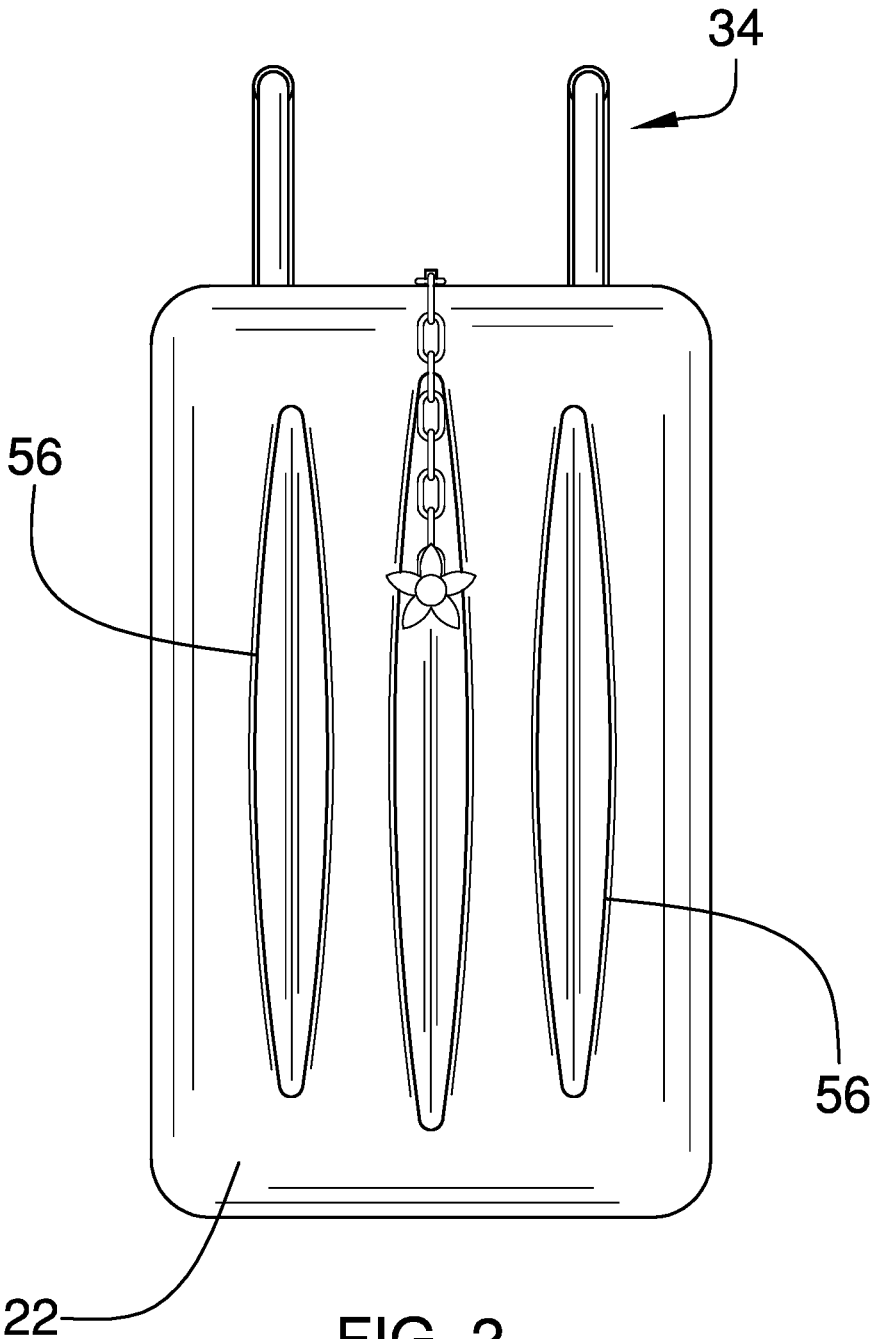
FIG. 2 is a front view of an embodiment of the disclosure.
Figure 3:
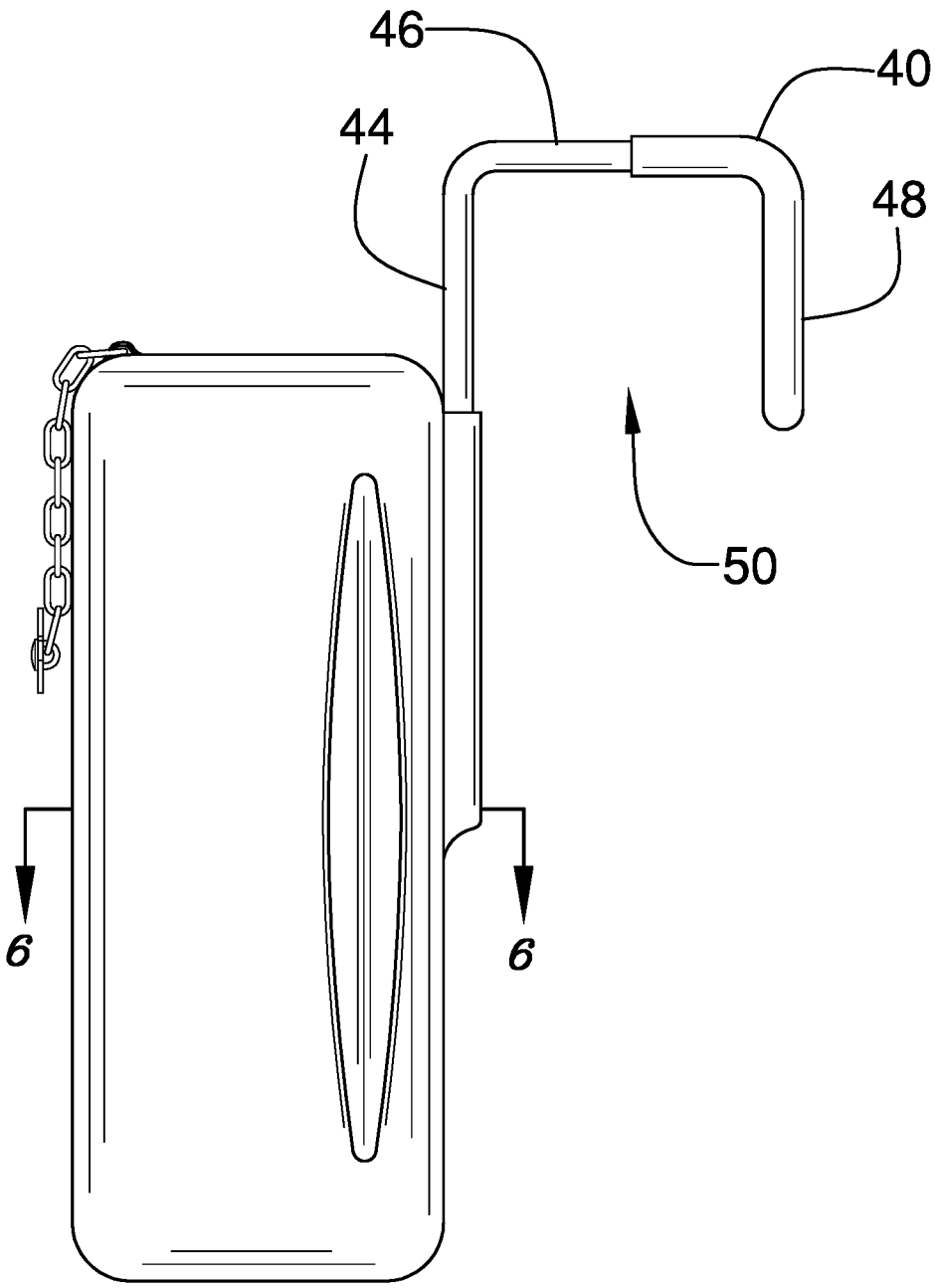
FIG. 3 is a side view of an embodiment of the disclosure.
Figure 4:
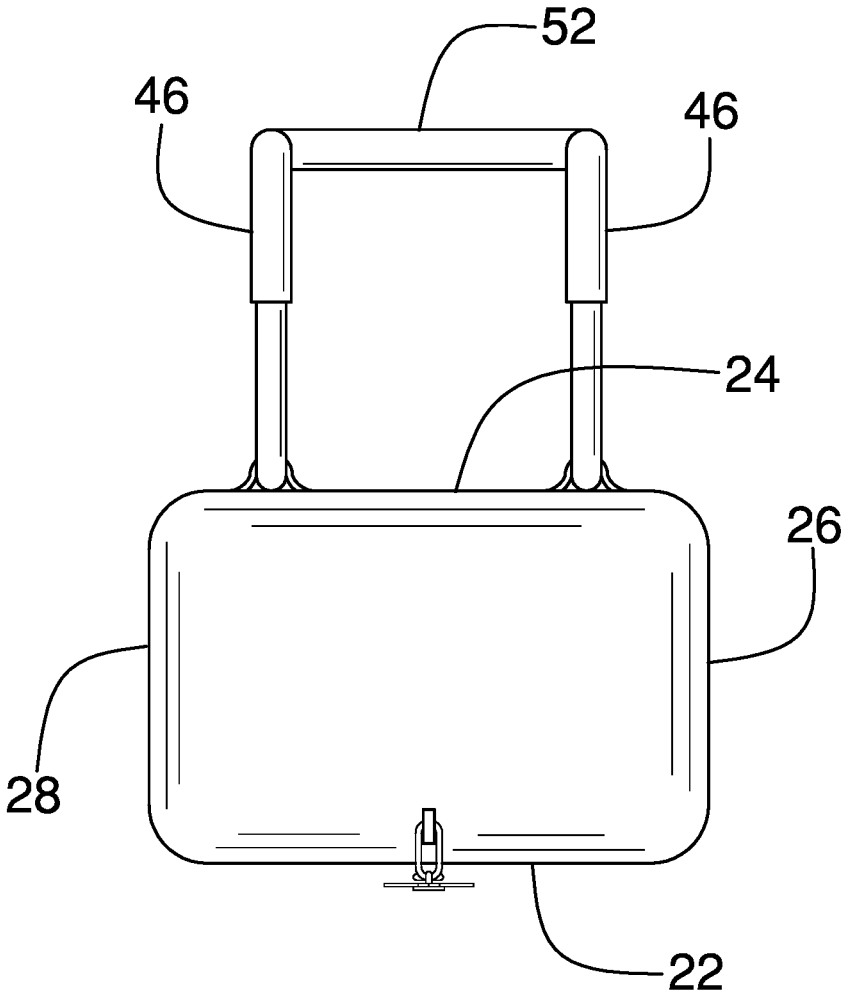
FIG. 4 is a top view of an embodiment of the disclosure.
Figure 5:
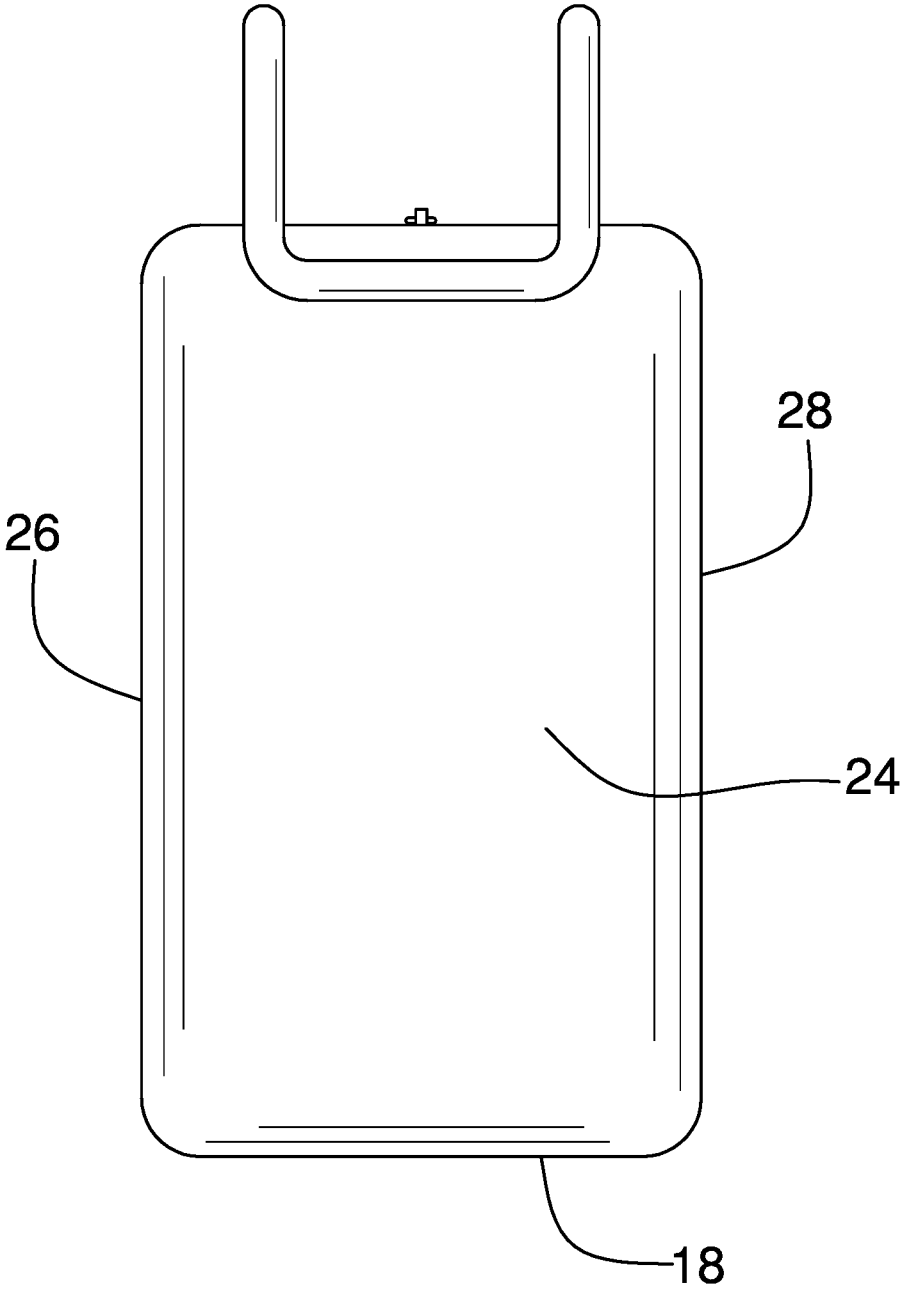
FIG. 5 is a rear view of an embodiment of the disclosure.
Figure 6:
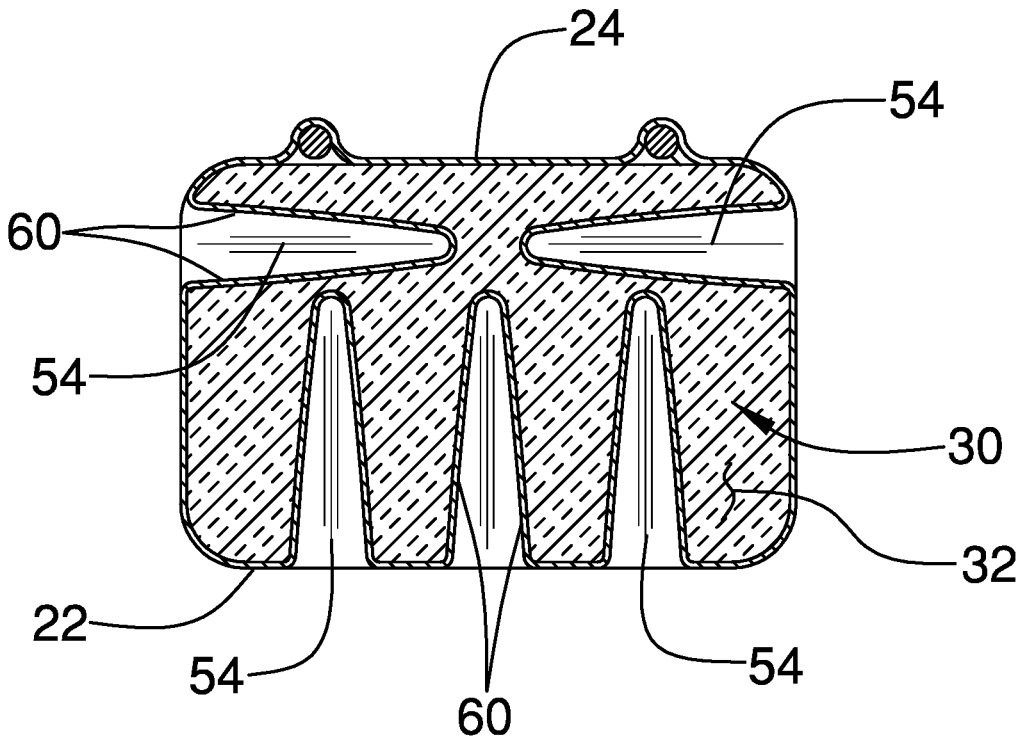
FIG. 6 is a cross-sectional view of an embodiment of the disclosure taken along line 6-6 of FIG. 3.
Figure 7:
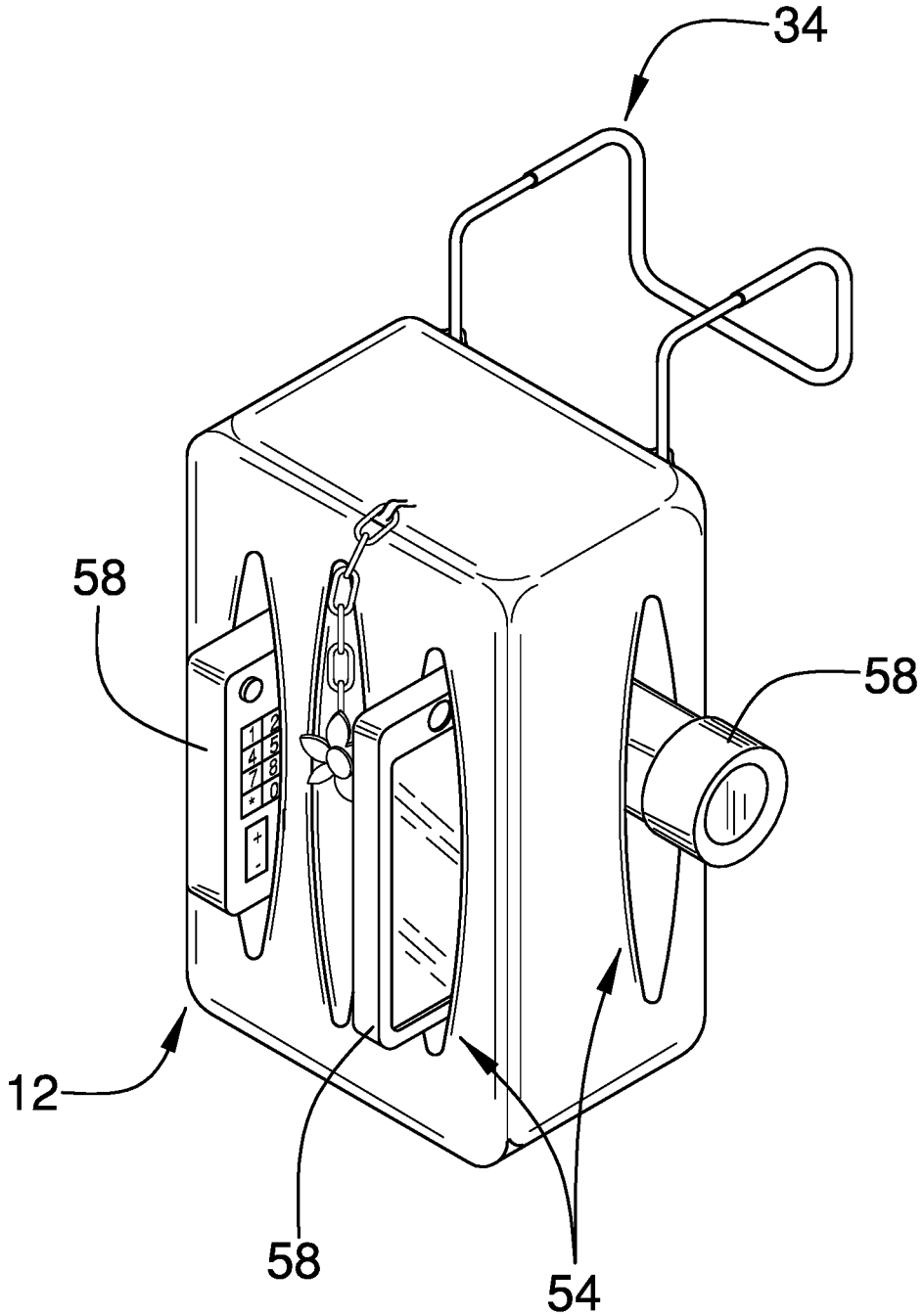
FIG. 7 is a top isometric view of an embodiment of the disclosure.

With reference now to the drawings, and in particular to FIGS. 1 through 8 thereof, a new article storage device embodying the principles and concepts of an embodiment of the disclosure and generally designated by the reference numeral 10 will be described.

As best illustrated in FIGS. 1 through 8, the bed mountable article storage assembly 10 generally comprises a housing 12 that has an outer wall 14 forming a top wall 16, a bottom wall 18, and a perimeter wall 20 that is attached to and extends between the top 16 and bottom 18 walls. In one embodiment, the perimeter wall 20 includes a front wall 22, a rear wall 24, a first lateral wall 26, and a second lateral wall 28 wherein the top 16 and bottom 18 walls have a rectangular shape. However, it should be understood that the housing 12 may have other shapes wherein the top 16 and bottom 18 walls are circular or have other geometric shapes.

The outer wall 14 is comprised of a flexible material. The flexible material will typically comprise a cloth material. The cloth material may include natural or synthetic cloth. However, other materials such as natural or synthetic leather, flexible plastics, and elastomers, for example, may be utilized. The flexible material will be flexible but will not tear or wear easily. An interior 30 of the housing 12 comprises a resiliently compressible material 32 which retains a shape of the housing 12. The resiliently compressible material 32 may include a foam material, compressible stuffing materials, and the like. This allows the housing 12 to be compressible and soft.

A coupler 34 is attached to the housing 12 and is configured to engage a headboard 36 of a bed 38. The coupler 34 includes a hook 40 that is positionable on an upper edge 42 of the headboard 36. In one embodiment, the hook 40 includes a leg 44 that is attached to and extends upwardly from the housing 12. An arm 46 is attached to the leg 44 distal to the housing 12 and extends away from the housing 12. The arm 46 is horizontally orientated when the leg 44 is vertically orientated. A catch 48 is attached to the arm 46 distal to the leg 44 and extends downwardly from the arm 46. A receiving space 50 for receiving the headboard 36 is defined between the catch 48 and the leg 44. The arm 46 is telescopic to selectively alter a depth of the receiving space 50. As is shown in the Figures, the coupler 34 may include a pair of legs 44, arms 46, and catches 48 as well as a brace 52 being attached to and extending between the catches 48.

A plurality of pockets 54 extends into the perimeter wall 20 and each of the pockets 54 may be lined with the flexible material used for the outer wall 14. Each of the pockets 54 comprises an elongated slot 56. Typically, each slot 56 has a length that is equal to at least 4.0 inches and each of the pockets 54 has a depth equal to at least 3.0 inches. While the Figures show that each slot 56 is vertically aligned, the slots 56 may also be provided in a horizontal orientation. The housing 12 has a height from the bottom wall 18 to the top wall 16 between 8.0 inches and 6.0 inches, and the housing 12 has a width and depth each being between 3.0 inches and 8.0 inches. In some embodiment, each of the front wall 22, the first lateral wall 26, and the second lateral wall 28 has at least one of the pockets 54 therein.

Figure 8:
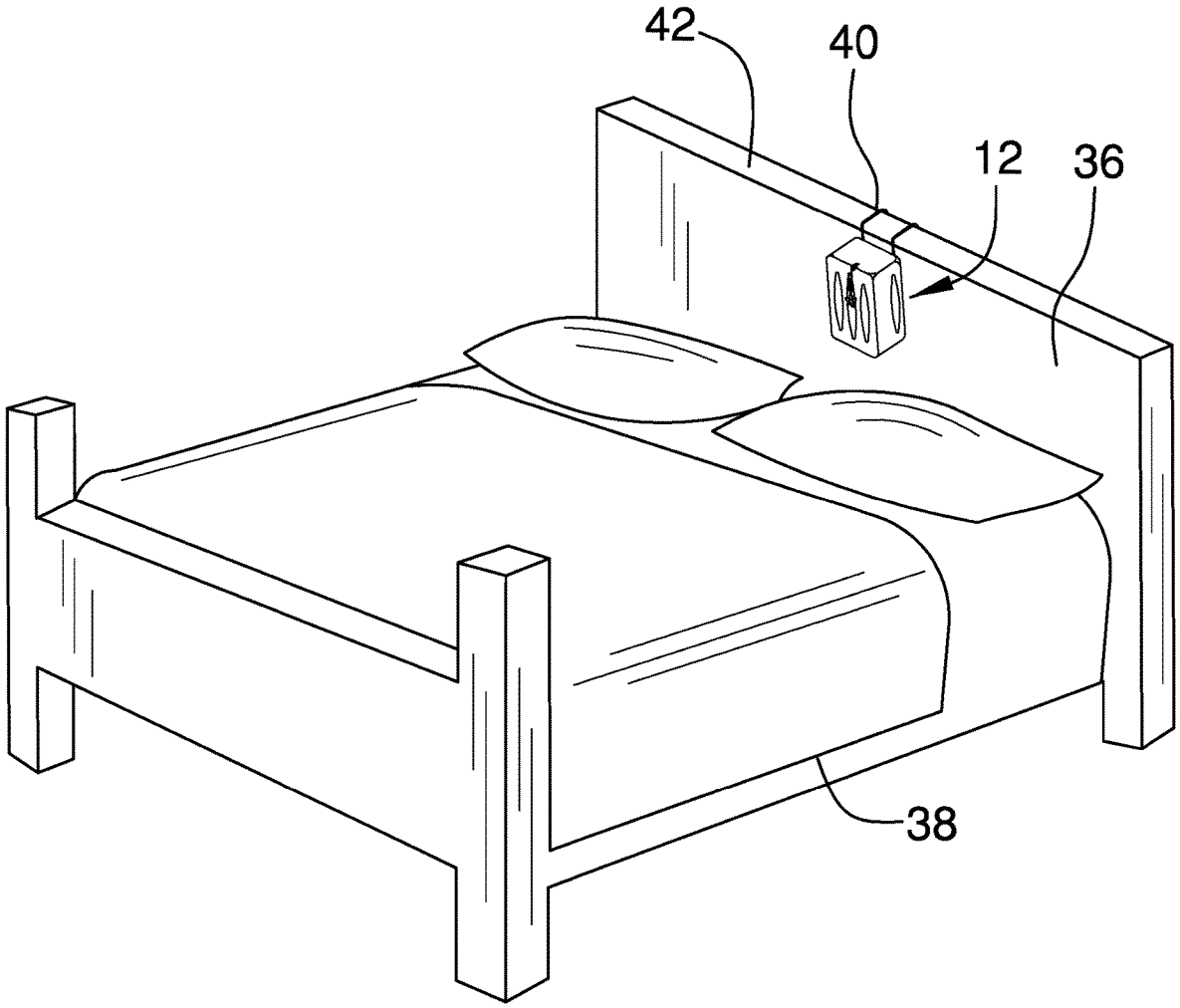
FIG. 8 is a top isometric in-use view of an embodiment of the disclosure.

In use, the coupler 34 is positioned over the upper edge 42 of the headboard 36 as shown in FIG. 8. This allows a user of the assembly to place small articles 58, such as cellular phones, television remote controls, pill bottles and the like in a convenient location and will prevent misplacing of the same. Because the slots 56 are elongated in one direction and essentially form slits in the housing 12, the side walls 60 of the pockets 54 frictionally engage the articles 58. The frictional engagement is enhanced by the housing 12 being filled with the resiliently compressible material 32 which also pushes against the side walls 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A storage system for storing a plurality of small articles, the storage system comprising:

a housing having an outer wall defining an interior of the housing, the outer wall forming a top wall, a bottom wall, and a perimeter wall being attached to and extending between the top and bottom walls;

the outer wall being comprised of a flexible material, the flexible material comprising a cloth material;

a coupler being attached to the housing, the coupler being configured to engage a headboard of a bed;

a resiliently compressible material positioned in and filling the interior of the housing, the resiliently compressible material retaining a shape of the housing; and a plurality of pockets extending integrally with the outer wall into the perimeter wall, each of the pockets comprising an elongated slot having a length being equal to at least 4.0 inches.

2. The storage system according to claim 1, wherein the perimeter wall includes a front wall, a rear wall, a first lateral wall, and a second lateral wall.

3. The storage system according to claim 1, wherein the coupler includes a hook including:

a leg being attached to and extending upwardly from the housing;

an arm being attached to the leg distal to the housing and extending away from the housing; and a catch being attached to the arm distal to the leg and extending downwardly from the arm, a receiving space for receiving the headboard being defined between the catch and the leg.

4. The storage system according to claim 3, wherein the arm is telescopic to selectively alter a depth of the receiving space.

5. The storage system according to claim 4, wherein the housing has a height from the bottom wall to the top wall between 8.0 inches and 6.0 inches, the housing having a width and depth each being between 3.0 inches and 8.0 inches.

6. The storage system according to claim 1, wherein the housing has a height from the bottom wall to the top wall between 8.0 inches and 6.0 inches, the housing having a width and depth each being between 3.0 inches and 8.0 inches.

7. The storage system according to claim 6, wherein the perimeter wall includes a front wall, a rear wall, a first lateral wall, and a second lateral wall.

8. The storage system according to claim 6, wherein each of the front wall, the first lateral wall, and the second lateral wall has at least one of the pockets therein.

9. A storage system for storing a plurality of small articles, the storage system comprising:

a housing having an outer wall defining an interior of the housing, the outer wall forming a top wall, a bottom wall, and a perimeter wall being attached to and extending between the top and bottom walls, the perimeter wall including a front wall, a rear wall, a first lateral wall, and a second lateral wall;

the outer wall being comprised of a flexible material, the flexible material comprising a cloth material;

a coupler being attached to the housing, the coupler being configured to engage a headboard of a bed, the coupler including a hook being positionable on an upper edge of the headboard, the hook including:

a leg being attached to and extending upwardly from the housing;

an arm being attached to the leg distal to the housing and extending away from the housing;

a catch being attached to the arm distal to the leg and extending downwardly from the arm, a receiving space for receiving the headboard being defined between the catch and the leg;

the arm being telescopic to selectively alter a depth of the receiving space;

a resiliently compressible material positioned in and filling the interior of the housing, the resiliently compressible material retaining a shape of the housing;

a plurality of pockets extending integrally with the outer wall into the perimeter wall, each of the pockets comprising an elongated slot having a length being equal to at least 4.0 inches;

the housing having a height from the bottom wall to the top wall between 8.0 inches and 6.0 inches, the housing having a width and depth each being between 3.0 inches and 8.0 inches; and each of the front wall, the first lateral wall, and the second lateral wall having at least one of the pockets therein.

* * * * *